US009752527B2

(12) United States Patent
Shimatsu

(10) Patent No.: US 9,752,527 B2
(45) Date of Patent: Sep. 5, 2017

(54) FUEL INJECTION DEVICE

(71) Applicant: KEIHIN CORPORATION, Shinjuku-ku, Tokyo (JP)

(72) Inventor: Takayuki Shimatsu, Shioya-gun (JP)

(73) Assignee: KEIHIN CORPORATION, Tokyo (JP)

( * ) Notice: Subject to any disclaimer, the term of this patent is extended or adjusted under 35 U.S.C. 154(b) by 116 days.

(21) Appl. No.: 14/689,395

(22) Filed: Apr. 17, 2015

(65) Prior Publication Data

US 2015/0308365 A1 Oct. 29, 2015

(30) Foreign Application Priority Data

Apr. 23, 2014 (JP) ..... 2014-089476

(51) Int. Cl.
*F02D 41/30* (2006.01)
*F02M 51/06* (2006.01)
*F02D 41/20* (2006.01)

(52) U.S. Cl.
CPC ..... *F02D 41/3005* (2013.01); *F02D 41/20* (2013.01); *F02M 51/061* (2013.01); *F02D 2041/2034* (2013.01); *F02D 2041/2055* (2013.01); *F02D 2041/2058* (2013.01)

(58) Field of Classification Search
CPC .. F02D 41/20; F02D 2041/2058; F02D 41/40; F02D 41/30; F02D 2041/2024; F02D 2041/2034; F02D 2041/2037; F02D 2041/2041; F02D 2041/2048; F02D 2041/2051; F02D 2041/2055; F02D 2041/2062; Y02T 10/123; Y02T 10/04; F02M 51/061
See application file for complete search history.

(56) References Cited

U.S. PATENT DOCUMENTS

2002/0189593 A1* 12/2002 Yamakado ..... F02D 41/20 123/490
2007/0175446 A1* 8/2007 Ishizuka ..... F02D 35/023 123/435
2009/0177367 A1* 7/2009 Toyohara ..... F02D 41/20 701/103

FOREIGN PATENT DOCUMENTS

JP 2006257968 A 9/2006

* cited by examiner

*Primary Examiner* — Sizo Vilakazi
(74) *Attorney, Agent, or Firm* — Cantor Colburn LLP

(57) ABSTRACT

A fuel injection device includes: a current control section which turns off a current which is applied by a current output section such that a timing at which fuel injection of a fuel injection section is ended becomes a timing coinciding with a timing at which fuel injection is ended in a case where a current is turned off from a predetermined current amount at which continuation of the fuel injection of the fuel injection section becomes possible, in a case where a fuel injection ending request timing of the fuel injection section is in a time domain in which a current which is applied by the current output section changes transiently.

3 Claims, 6 Drawing Sheets

FUEL INJECTION DEVICE

CROSS-REFERENCE TO RELATED APPLICATION

The present invention claims priority under 35 U.S.C. §119 to Japanese Application No. 2014-089476 filed Apr. 23, 2014, the entire content of which is incorporated herein by reference.

BACKGROUND

Field of the Invention

The present invention relates to a fuel injection device.

Description of Related Art

In an automobile or the like, in order to appropriately maintain fuel economy or driving performance, there is a case where the amount of fuel which is supplied to an internal combustion engine such as an engine is controlled according to a situation at the time of fuel injection.

In Japanese Unexamined Patent Application, First Publication No. 2006-257968, as a related technique, a technique related to control of accurately injecting a very small amount of fuel corresponding to a requested injection time shorter than a peak current application time, as requested, is described.

SUMMARY

In general, a fuel injection device adjusts the amount of fuel which is supplied to an internal combustion engine by controlling a current in a solenoid coil in the fuel injection device and opening and closing a valve by generating a magnetic force by the solenoid coil.

However, depending on the timing of stopping fuel supply to the internal combustion engine, there is a case where the characteristic of a fuel flow rate with respect to energization time changes in a case of turning off a current in each of a period in which a nearly constant current called a valve opening current for opening the valve flows through the solenoid coil, a period in which a nearly constant current called a holding current flows through the solenoid coil in order to maintain the state of the open valve, and a period in which a current changes transiently.

For this reason, a technique is required in which even if the timing of stopping fuel supply to the internal combustion engine is a timing at which a current which is applied to the solenoid coil in order to open and close the valve changes transiently, it is possible to stabilize the amount of fuel which the fuel injection device supplies to the internal combustion engine.

An aspect related to the present invention has an object to provide a fuel injection device capable of solving the above problem.

In order to achieve such an object by solving the above problem, the present invention adopts the following aspect.

(A) According to an aspect of the present invention, there is provided a fuel injection device including: a current control section which turns off a current which is applied by a current output section such that a timing at which fuel injection of a fuel injection section is ended becomes a timing coinciding with a timing at which fuel injection is ended in a case where a current is turned off from a predetermined current amount at which continuation of the fuel injection of the fuel injection section becomes possible, in a case where a fuel injection ending request timing of the fuel injection section is in a third time domain in which a current which is applied by the current output section changes transiently, between a first time domain in which the current output section applies a predetermined current amount at which the fuel injection of the fuel injection section becomes possible and a second time domain in which the current output section applies a predetermined current amount at which continuation of the fuel injection of the fuel injection section becomes possible.

(B) In the aspect according to the above (A), the current control section may turn off a current which is applied by the current output section, at a timing earlier than the fuel injection ending request timing of the fuel injection section, based on a correction amount for a timing of turning off a current of the current output section corresponding to the fuel injection ending request timing of the fuel injection section prepared for each of a plurality of different power-supply voltages in the current output section.

(C) In the aspect according to the above (A) or (B), the fuel injection device may further include: a time monitoring section which identifies a current timing with a timing at which the current output section begins to apply a current as a starting point; a current detection section which detects a current amount of a current which is applied by the current output section; and a current amount writing section which records the current timing identified by the time monitoring section and the current amount of a current, which is applied by the current output section, detected by the current detection section and corresponding to the current timing, in a storage section with the current timing and the current amount correlated with each other.

(D) In the aspect according to any one of the above (A) to (C), the current control section may correct a timing of turning off a current which is applied by the current output section, based on a deviation of a timing at which a current which is applied by the current output section rises to a valve opening current, with respect to a predetermined timing.

(E) In the aspect according to any one of the above (A) to (D), the fuel injection device may further include: a current output section which outputs a current to the fuel injection section based on control by the current control section; and a fuel injection section which injects fuel based on the current which is output by the current output section.

According to the aspect related to the present invention, even if the timing of turning off a current which is applied by the current output section is a timing at which a current which is applied to a solenoid coil in order to open and close a valve changes transiently, it is possible to stabilize the amount of fuel which the fuel injection device supplies to an internal combustion engine.

DESCRIPTION OF THE EMBODIMENTS

Embodiment

Figure 1:
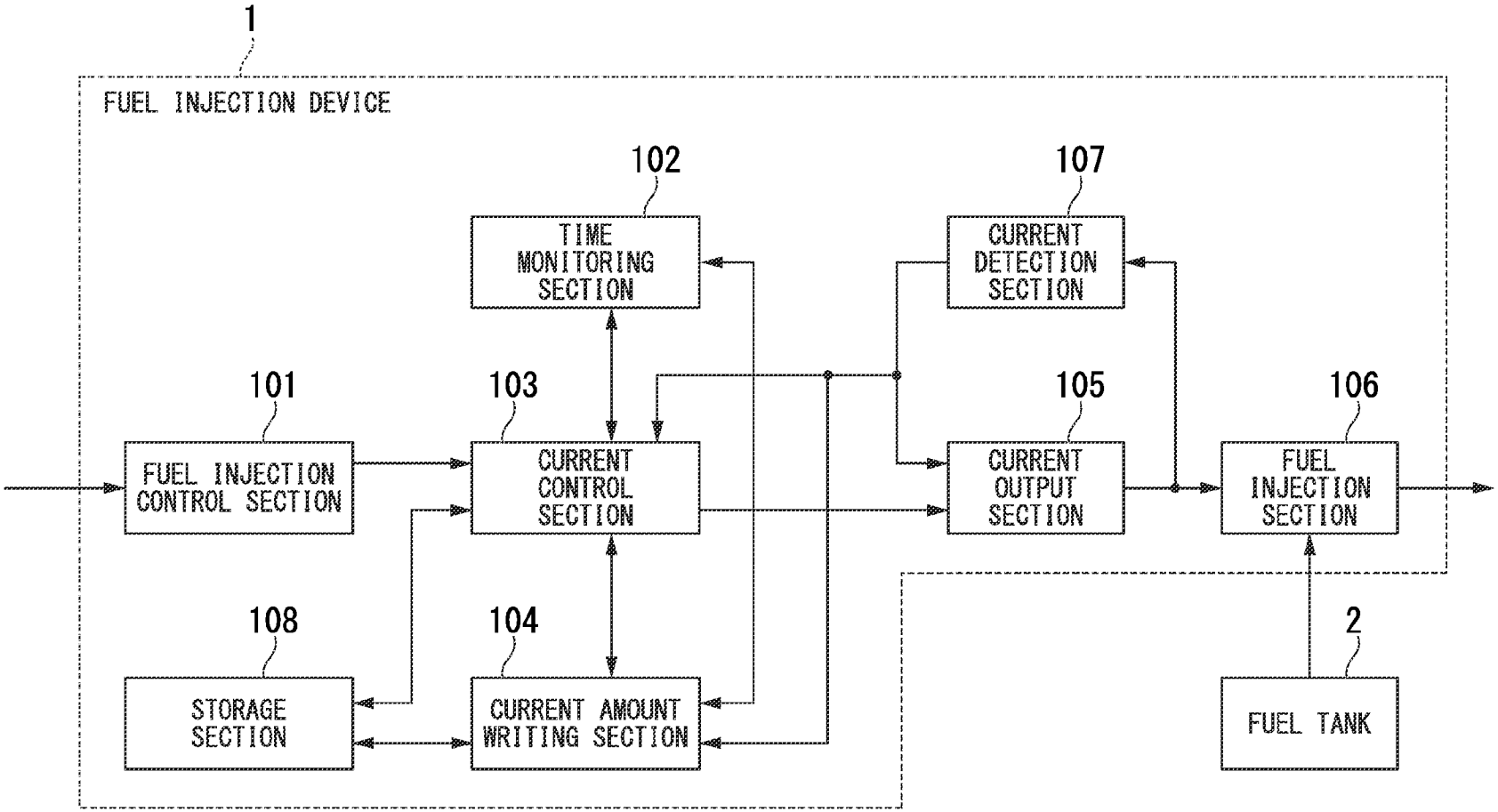
FIG. 1 is a diagram showing an example of a fuel injection device according to an embodiment of the present invention.

FIG. 1 is a diagram showing an example of a fuel injection device 1 according to an embodiment of the present invention.

The fuel injection device 1 according to this embodiment is provided with a fuel injection control section 101, a time monitoring section 102, a current control section 103, a current amount writing section 104, a current output section 105, a fuel injection section 106, a current detection section 107, and a storage section 108, as shown in FIG. 1. In addition, in FIG. 1, a fuel tank 2 is described along with the fuel injection device 1.

The fuel injection control section 101 provided with the fuel injection device 1 outputs a signal related to the start of fuel injection to the current control section 103 based on an engine operating state. In addition, the signal related to the start of fuel injection includes information about the timing of ending fuel injection.

The time monitoring section 102 identifies a current timing with a timing at which the current output section 105 begins to apply a current as the starting point.

The current control section 103 turns off a current which is applied by the current output section 105 such that a timing at which the fuel injection of the fuel injection section 106 is ended becomes a timing coinciding with a timing at which fuel injection is ended in a case where a current is turned off from a predetermined current amount at which continuation of the fuel injection of fuel injection section 106 becomes possible, in a case where a fuel injection ending request timing of the fuel injection section 106 is in a third time domain in which a current which is applied by the current output section 105 changes transiently, between a first time domain in which the current output section 105 applies a predetermined current amount at which the fuel injection of the fuel injection section 106 becomes possible and a second time domain in which the current output section 105 applies a predetermined current amount at which continuation of the fuel injection of the fuel injection section 106 becomes possible.

Further, the current control section 103 turns off a current which is applied by the current output section 105, at a timing earlier than the fuel injection ending request timing of the fuel injection section 106, based on a correction amount for a timing of turning off a current, corresponding to a timing before correction at which the current control section 103 turns off a current, prepared for each of a plurality of different power-supply voltages in the current output section 105.

Further, the current control section 103 performs control such that the current output section 105 outputs a predetermined current amount at which the fuel injection of the fuel injection section 106 becomes possible and a predetermined current amount at which continuation of the fuel injection of the fuel injection section 106 becomes possible, at a predetermined time in accordance with the dynamic characteristics of the fuel injection section 106.

The current amount writing section 104 records the current timing identified by the time monitoring section 102 and a current amount of a current which is applied by the current output section 105, corresponding to the current timing detected by the current detection section 107, in the storage section 108 with the current timing and the current amount correlated with each other.

The current output section 105 outputs a current to the fuel injection section 106 based on the control by the current control section 103.

The fuel injection section 106 takes in fuel from the fuel tank 2. The fuel injection section 106 injects fuel taken in from the fuel tank 2, based on a current which is output by the current output section 105.

For example, the fuel injection section 106 is an injector which supplies fuel to an internal combustion engine by opening and closing a valve by applying a current to a solenoid coil.

The current detection section 107 detects a current amount which the current output section 105 outputs to the fuel injection section 106. The current detection section 107 outputs the detected current amount to the current amount writing section 104.

The storage section 108 stores information necessary for a variety of processing which is executed the fuel injection device 1. For example, the storage section 108 stores the current timing detected by the current detection section 107 and the current amount of a current which is applied by the corresponding current output section 105, with the current timing and the current amount correlated with each other.

The fuel tank 2 stores fuel to be supplied to the fuel injection section 106. For example, fuel which is stored in the fuel tank 2 is gaseous fuel or liquid fuel. The gaseous fuel is compressed natural gas (CNG) or the like. Further, the liquid fuel is gasoline or the like.

Figure 2A:
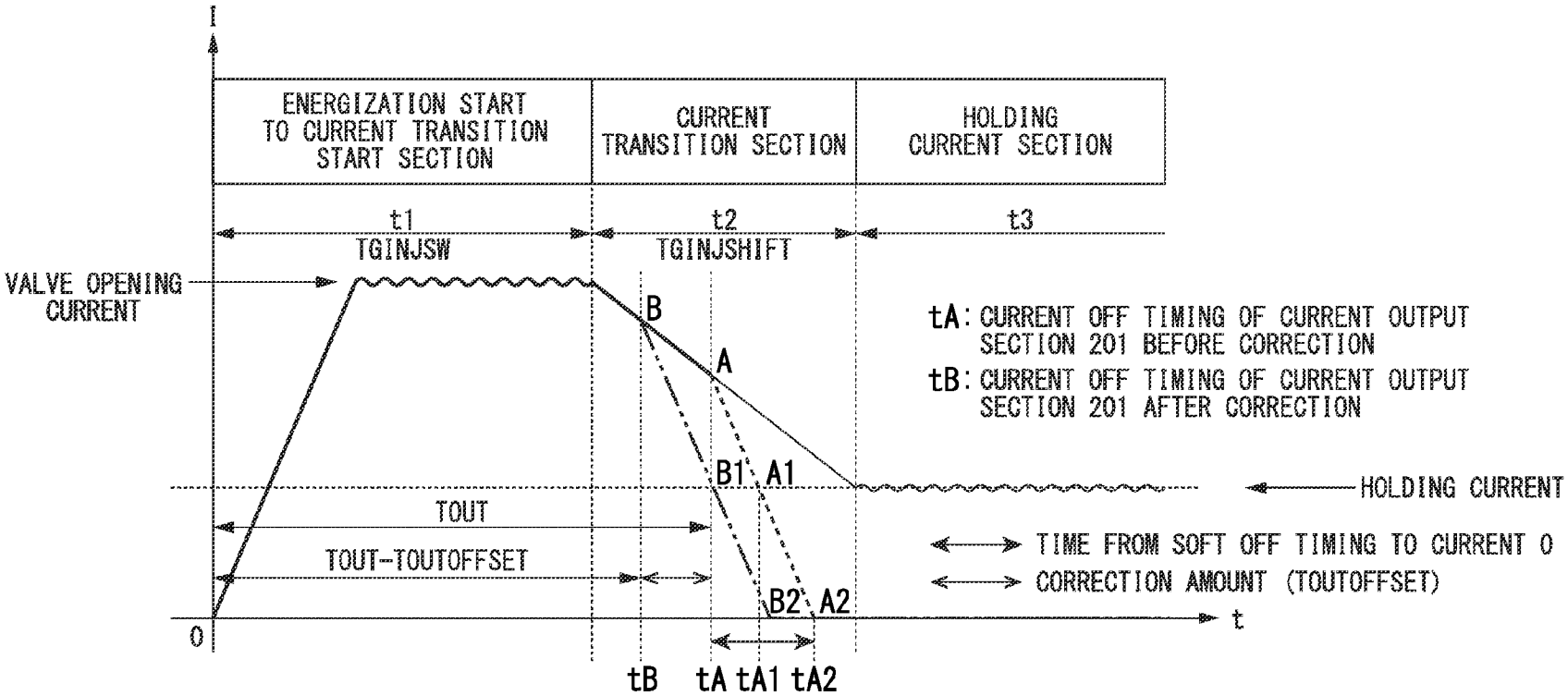
FIG. 2A is a diagram showing an example of correction of a current stop timing of a current output section of the embodiment.
Figure 2B:
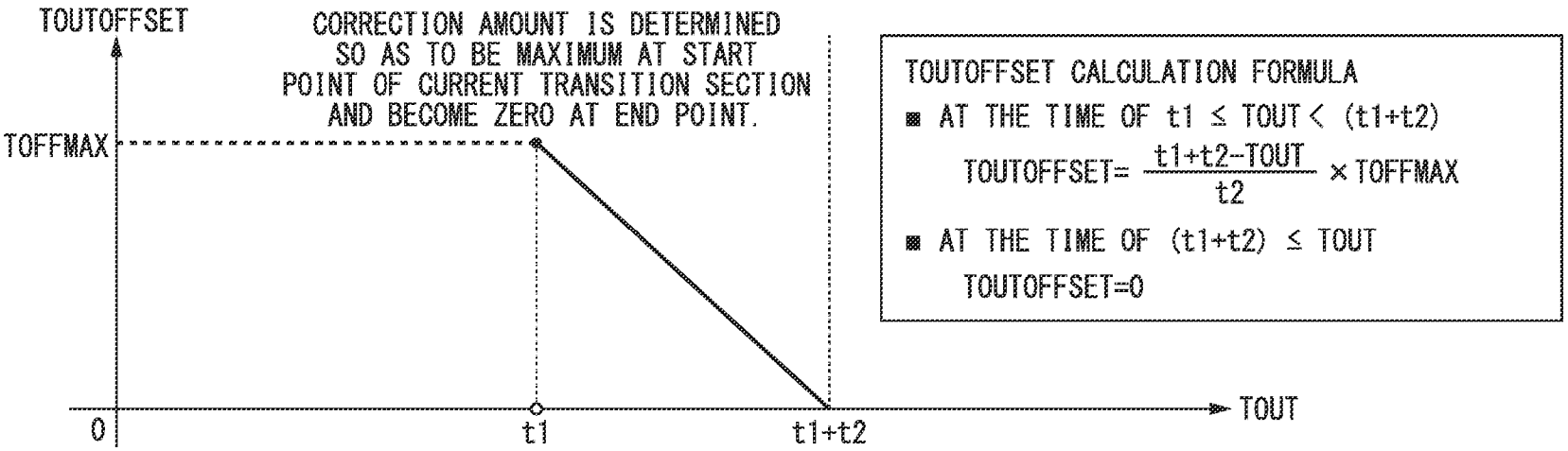
FIG. 2B is a diagram showing an example of correction of the current stop timing of the current output section of the embodiment.

FIGS. 2A and 2B are diagrams showing an example of correction of a current stop timing of the current output section 105 of this embodiment.

FIG. 2A shows change in a current which the current output section 105 outputs to the fuel injection section 106. The vertical axis shows a current amount. The horizontal axis shows time with a timing at which the current output section 105 begins to apply a current to the fuel injection section 106 as the starting point (t=0).

Time t1 (TGINJSW) described as an "energization start to current transition star section" is a time period (a first time domain) from the time when the current output section 105 begins to apply a current to the time when the flow of a valve opening current indicating a current necessary to cause the valve to transition from a closed state to an open state is ended. Time t3 described as a "holding current section" is a period (a second time domain) of applying a holding current indicating a current which has to be applied in order to cause the valve being in the open state due to the valve opening current in time t1 to continue to be maintained in the open state. Further, time t2 described as a "current transition section" indicates a period (a third time domain) in which a current amount transiently changes from first time domain to the second time domain.

Time TOUT is a request time when the current output section 105 applies a current to the fuel injection section 106.

The time TOUT is a time which is determined by the fuel injection control section 101 for each fuel injection timing, based on a situation from each sensor in the internal combustion engine, and is a time which is determined before the current output section 105 outputs a current to the fuel injection section 106.

Here, a method of correcting a current stop timing of the current output section 105 will be described. In addition, a timing A (a fuel injection ending request timing) of the end of the time TOUT is set to be in the "current transition section".

Before the correction of the current stop timing, the current control section 103 turns off a current which is applied by the current output section 105 at a timing of tA based on TOUT calculated by the fuel injection control section 101. Then, a current which is applied by the current output section 105 changes from a point A at the timing tA to a point A2 via a point A1. The point A1 is a point at which a current which is applied by the current output section 105 becomes equal to the holding current.

Here, a timing at which a current which is applied by the current output section 105 becomes equal to the holding current is set to be tA1. Further, a timing at which a current which is applied by the current output section 105 becomes zero is set to be tA2. A change in a current which is applied by the current output section 105 during the time from the point tA1 to the point tA2 can be regarded as a current change equivalent to that in normal control in which the current control section 103 makes the holding current which is applied by the current output section 105 be in an OFF state at time t3 based on TOUT calculated by the fuel injection control section 101. Therefore, in a case where the current control section 103 makes a current which is applied by the current output section 105 be in an OFF state at time t2 based on TOUT calculated by the fuel injection control section 101, a valve opening time becomes longer by the time of (tA1−tA) in which a current changes from the point A to the point A1, as compared to the normal control.

In the correction of the current stop timing, the current control section 103 performs correction so as to make a timing of turning off a current which is applied by the current output section 105 earlier by a time of (tA1−tA).

FIG. 2B shows correction time TOUTOFFSET in which the current control section 103 performs correction at the timing of each TOUT. Here, for convenience of description, a graph is shown. However, in fact, the storage section 108 stores information about the contents equivalent to a graph, rather than a graph itself. For example, the storage section 108 stores a calculation formula of TOUTOFFSET for each condition of TOUT. Further, the storage section 108 may store TOUTOFFSET corresponding to TOUT as a data table. In addition, information about the contents equivalent to a graph, such as a calculation formula or a data table, is prepared for each power-supply voltage of the current output section 105 and stored by the storage section 108.

The horizontal axis of the graph shown in FIG. 2B shows TOUT calculated by the fuel injection control section 101. Further, the vertical axis of the graph shows the correction amount TOUTOFFSET of a timing of turning off a current which is applied by the current output section 105, for each TOUT. In the example of the graph shown in FIG. 2B, the correction amount TOUTOFFSET between a timing at which TOUT is t1 and a timing at which TOUT is t2 is linearly interpolated. The current control section 103 corrects TOUT to (TOUT−TOUTOFFSET) based on TOUT calculated by the fuel injection control section 101. Then, the current control section 103 turns off the current which is applied by the current output section 105 at a timing of (TOUT−TOUTOFFSET). For example, in a case where TOUT is greater than or equal to t1 and TOUT is smaller than or equal to (t1+t2) (in a case of turning off a current which is applied by the current output section 105 in the third time domain), TOUTOFFSET becomes a value of (t1+t2−TOUT)×TOFFMAX/t2. The current control section 103 turns off a current which is applied by the current output section 105 at a timing of (TOUT−TOUTOFFSET) identified by using TOUTOFFSET. Further, in a case where TOUT is greater than or equal to (t1+t2) (in a case of turning off a current which is applied by the current output section 105 in the second time domain), TOUTOFFSET becomes zero. The current control section 103 turns off the current which is applied by the current output section 105 at a timing of TOUT identified by using TOUTOFFSET.

Figure 3:
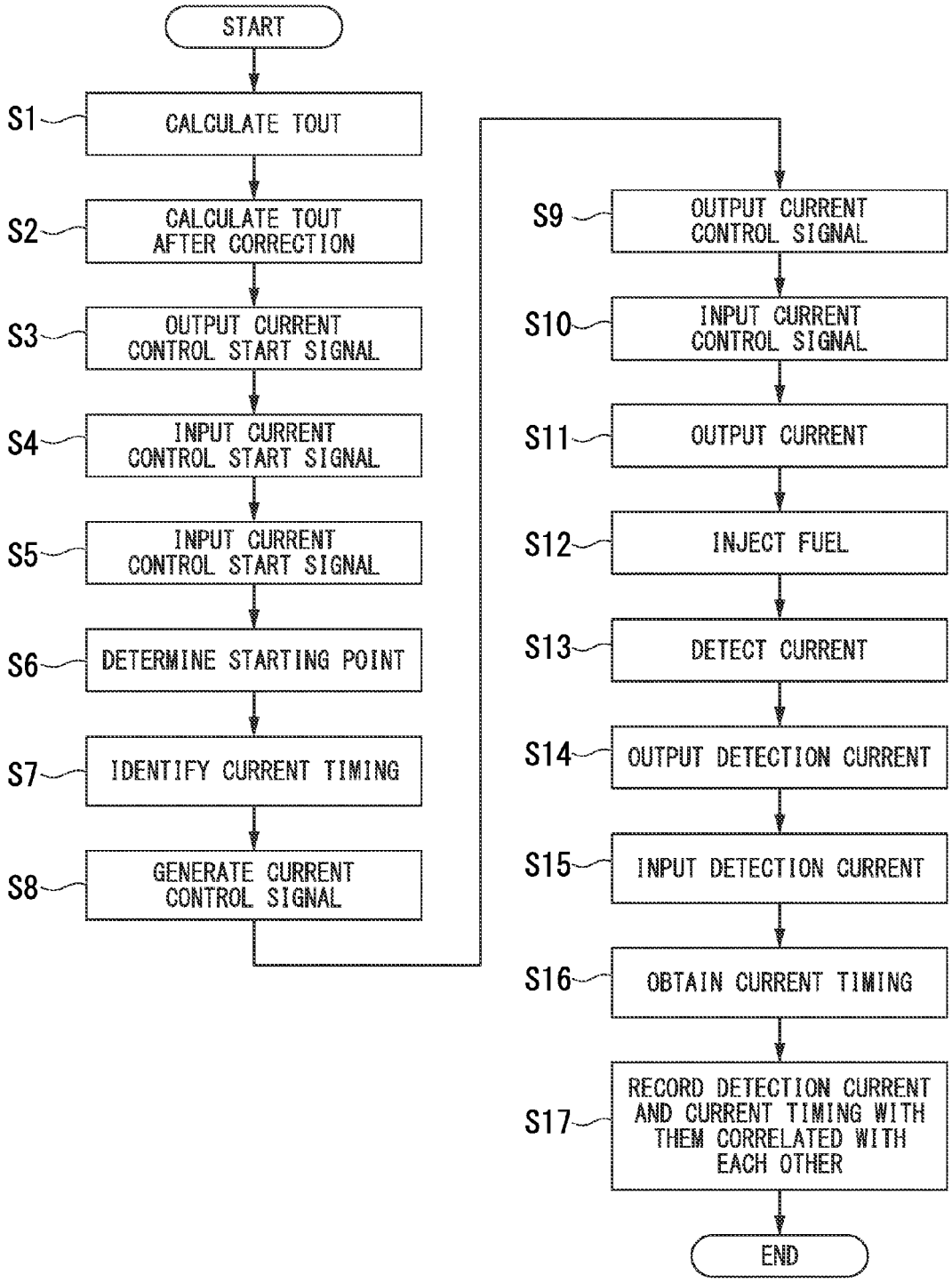
FIG. 3 is a diagram showing an example of processing of the fuel injection device according to this embodiment.

FIG. 3 is a diagram showing an example of processing of the fuel injection device 1 according to this embodiment.

Next, the processing of the fuel injection device 1 according to this embodiment will be described by using FIG. 3.

A request for fuel injection is given in synchronization with the rotation of an engine. For example, a separate device from the fuel injection device 1 detects a crank angle of the engine and determines a fuel injection timing. The separate device from the fuel injection device 1 outputs a fuel injection start timing signal indicating a start timing of fuel injection to the fuel injection control section 101.

The fuel injection start timing signal is input from the separate device from the fuel injection device 1 to the fuel injection control section 101 which the fuel injection device 1 includes. Then, the fuel injection control section 101 outputs a fuel injection start signal indicating the detection of the fuel injection start timing to the current control section 103. Further, the fuel injection control section 101 calculates the request time TOUT at which a current is applied to the current output section 105, based on a situation in each sensor in an internal combustion engine, (step S1), and outputs information about TOUT to the current control section 103.

Further, if the fuel injection start signal and information about TOUT are input from the fuel injection control section 101, the current control section 103 reads correction amount information indicating a corresponding relationship between TOUT and the correction amount TOUTOFFSET from the storage section 108. For example, the correction amount information is the calculation formula of TOUTOFFSET for each condition of TOUT, described with respect to FIG. 2B. Further, the correction amount information may be a data table in which TOUT is correlated with corresponding TOUTOFFSET. Further, a correction amount which the correction amount information indicates may be a linearly-interpolated correction amount. Further the correction amount which the correction amount information indicates may be a correction amount taking into account nonlinearity based on actual measurement values of a current output from the current output section 105 and detected by the current detection section 107.

In addition, the current control section 103 may read in correction amount information from the storage section 108 in advance.

The current control section 103 calculates TOUT after correction by subtracting the calculated TOUTOFFSET from TOUT input from the fuel injection control section 101 (step S2).

Then, the current control section 103 outputs a current control start signal for starting control of a current amount which the current output section 105 outputs to the fuel injection 106, to the time monitoring section 102 and the current output section 105 (step S3). The current control start signal is a signal for causing the current output section 105 to begin to apply a current.

The current control start signal is input from the current control section 103 to the current output section 105 (step S4). Then, the current output section 105 starts output of a current to the fuel injection section 106.

The current control start signal is input from the current control section 103 to the current monitoring section 102 (step S5). Then, the current monitoring section 102 sets a timing at which the current control start signal is input to be a timing at which the current output section 105 begins to apply a current to the fuel injection section 106 and determines the timing as a starting point (step S6). The start point determined by the current monitoring section 102 is t=0 in FIG. 2A. The current monitoring section 102 identifies the current timing based on the starting point (step S7). The current monitoring section 102 outputs the identified current timing to the current control section 103.

If the current timing is input from the current monitoring section 102 to the current control section 103, the current control section 103 generates a current control signal for controlling a current amount which the current output section 105 outputs to the fuel injection section 106, based on the input current timing and information about TOUT after correction (step S8).

For example, the current control section 103 performs control such that the current output section 105 applies a predetermined current amount at which the fuel injection of the fuel injection section 106 becomes possible, between a time from the starting point determined by the time monitoring section 102 to a time after a current begins to be output from the current output section 105 and until the valve of the fuel injection section 106 is opened, and a time set in advance in consideration of dynamic characteristics until valve opening is stabilized. Thereafter, the current control section 103 performs control such that the current output section 105 applies a predetermined current amount at which continuation of the fuel injection of the fuel injection section 106 becomes possible. Then, the current control section 103 performs control so as to stop output of a current from the current output section 105 at the point in time when TOUT after correction calculated in step S2 has elapsed.

The current control section 103 outputs the generated current control signal to the current output section 105 (step S9).

The current control signal is input from the current control section 103 to the current output section 105 (step S10). The current output section 105 outputs a current according to the input current control signal to the fuel injection section 106 (step S11). For example, the current output section 105 performs feedback control such that a current value output from the current output section 105 and detected by the current detection section 107 becomes a target current value, based on the current control signal input from the current control section 103.

The fuel injection section 106 injects fuel taken in from the fuel tank 2 to the internal combustion engine based on a current which is output by the current output section 105 (step S12). For example, the fuel injection section 106 is an injector which supplies fuel to the internal combustion engine by opening and closing a valve by applying a current to a solenoid coil. If a valve opening current is applied to the solenoid coil of the fuel injection section 106 by the current output section 105, the solenoid coil generates a magnetic force. The valve of the fuel injection section 106 enters an open state due to the magnetic force. Further, in a case where a current amount which is applied to the solenoid coil of the fuel injection section 106 by the current output section 105 is smaller than the holding current, the magnetic force having been generated in the solenoid coil of the fuel injection section 106 is reduced, and thus the valve of the fuel injection section 106 enters a closed state.

When acting as described above, even if a timing of stopping fuel supply to the internal combustion engine is a timing at which a current which is applied to the solenoid coil in order to open and close the valve changes transiently, it is possible to stabilize the amount of fuel which the fuel injection device supplies to the internal combustion engine.

Further, the current detection section 107 detects a current which the current output section 105 outputs to the fuel injection section 106 according to the input current control signal (step S13). The current detection section 107 outputs the detected detection current to the current amount writing section 104 (step S14).

The detection current is input from the current detection section 107 to the current amount writing section 104 which the fuel injection device 1 includes (step S15). Then, the current amount writing section 104 accesses the time monitoring section 102 and obtains information indicating the current timing from the time monitoring section 102 (step S16).

The current amount writing section 104 records the detection current input from the current detection section 107 and the current timing obtained from the time monitoring section 102 in the storage section 108 with the detection current and the current timing correlated with each other (step S17). The processing of step S17 performed by the current amount writing section 104 is performed every time the detection current is input from the current detection section 107.

When acting as described above, it is possible to make the valve be in a closed state with more accurate timing based on an actual measurement value recorded in the storage section 108 with the detection current detected from the current detection section 107 and the current timing obtained from the time monitoring section 102 correlated with each other, and thus, even in a case where a current which is applied to the solenoid coil changes transiently, it is possible to stabilize the amount of fuel which the fuel injection device 1 supplies to the internal combustion engine.

In addition, the current control section 103 may perform control such that the total current amount of a current which is applied by the current output section 105 becomes constant until a timing of ending the fuel injection of the fuel injection section 106, so as to correct variation which occurs when a current which is applied by the current output section 105 rises to a valve opening current.

In this way, even in a case where variation occurring when a current which is applied by the current output section 105 rises to a valve opening current occurs, it is possible to stabilize the amount of fuel which the fuel injection device 1 supplies to the internal combustion engine.

The processing of the fuel injection device 1 according to this embodiment has been described above. According to the fuel injection device 1 described above, the fuel injection device 1 is provided with the current control section 103 and the time monitoring section 102. The current control section 103 controls a current related to the fuel injection of the fuel injection section 106, which the current output section 105 applies, based on a signal related to the start of fuel injection. The time monitoring section 102 identifies the current timing. The current control section 103 turns off a current of the current output section 105 such that a timing at which the fuel injection of the fuel injection section 106 is ended coincides with a timing at which fuel injection is ended in a case where a current is turned off from a predetermined current amount at which continuation of the fuel injection of the fuel injection section 106 becomes possible, in a case where the fuel injection ending request timing of the fuel injection section 106 is in the third time domain in which a current which is applied by the current output section 105 changes transiently, between the first time domain in which the current output section 105 applies a predetermined current amount at which the fuel injection of the fuel injection section 106 becomes possible and the second time domain in which the current output section 105 applies a predetermined current amount at which continuation of the fuel injection of the fuel injection section 106 becomes possible.

In this way, even if a timing of turning off a current which is applied by the current output section is a timing at which a current which is applied to the solenoid coil in order to open and close the valve changes transiently, it is possible to stabilize the amount of fuel which the fuel injection device supplies to the internal combustion engine.

Further, the current detection section 107 detects a current which the current output section 105 outputs to the fuel injection section 106 according to the input current control signal. The current detection section 107 outputs the detected detection current to the current amount writing section 104. The detection current is input from the current detection section 107 to the current amount writing section 104 which the fuel injection device 1 includes. The current amount writing section 104 accesses the time monitoring section 102 and obtains information indicating the current timing from the time monitoring section 102. The current amount writing section 104 records the detection current input from the current detection section 107 and the current timing obtained from the time monitoring section 102 in the storage section 108 with the detection current and the current timing correlated with each other. The current control section 103 controls a current amount of the current output section 105 based on the actual measurement value recorded in the storage section 108 by the current amount writing section 104, thereby controlling the fuel injection of the fuel injection section 106.

In this way, it is possible to make the valve be in a closed state with more accurate timing based on the actual measurement value recorded in the storage section 108 with the detection current input from the current detection section 107 and the current timing obtained from the time monitoring section 102 correlated with each other, and thus, even in a case where a current which is applied to the solenoid coil changes transiently, it is possible to stabilize the amount of fuel which the fuel injection device 1 supplies to the internal combustion engine.

Further, the current control section 103 corrects a timing of turning off a current which is applied by the current output section 105, based on a deviation of a timing at which a current which is applied by the current output section 105 rises to a valve opening current, with respect to a predetermined timing. In addition, the predetermined timing here is a timing determined based on timing design.

In this way, even in a case where variation occurring when a current which is applied by the current output section 105 rises to a valve opening current occurs, it is possible to stabilize the amount of fuel which the fuel injection device 1 supplies to the internal combustion engine.

In addition, the storage section 108 of this embodiment may be provided anywhere in an area in which transmission and reception of appropriate information is performed. Further, a plurality of storage sections 108 may be present in an area in which transmission and reception of appropriate information is performed, and store data in a dispersed manner.

In addition, in the processing flow of this embodiment, the order of processing may be changed in a range in which appropriate processing is performed.

Example

Figure 4A:
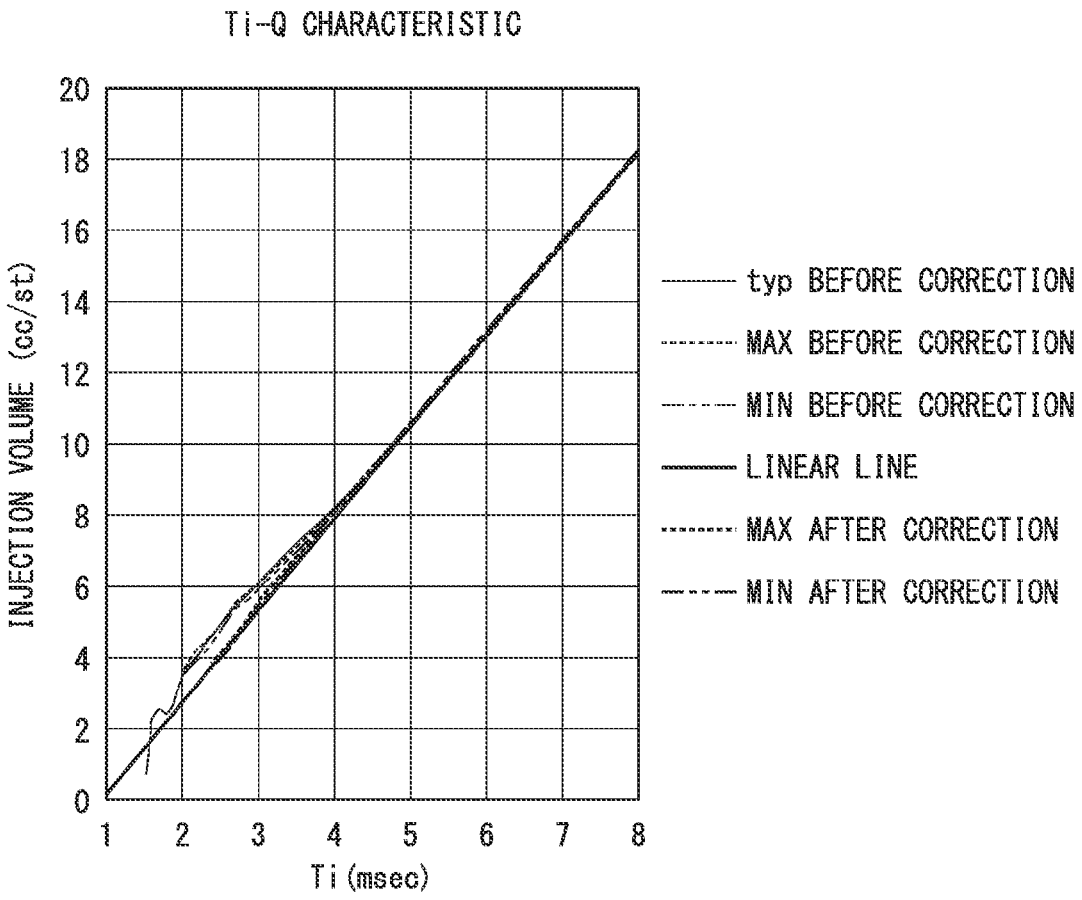
FIG. 4A is a diagram showing an example of experimental results of the fuel injection device according to this embodiment.
Figure 4B:
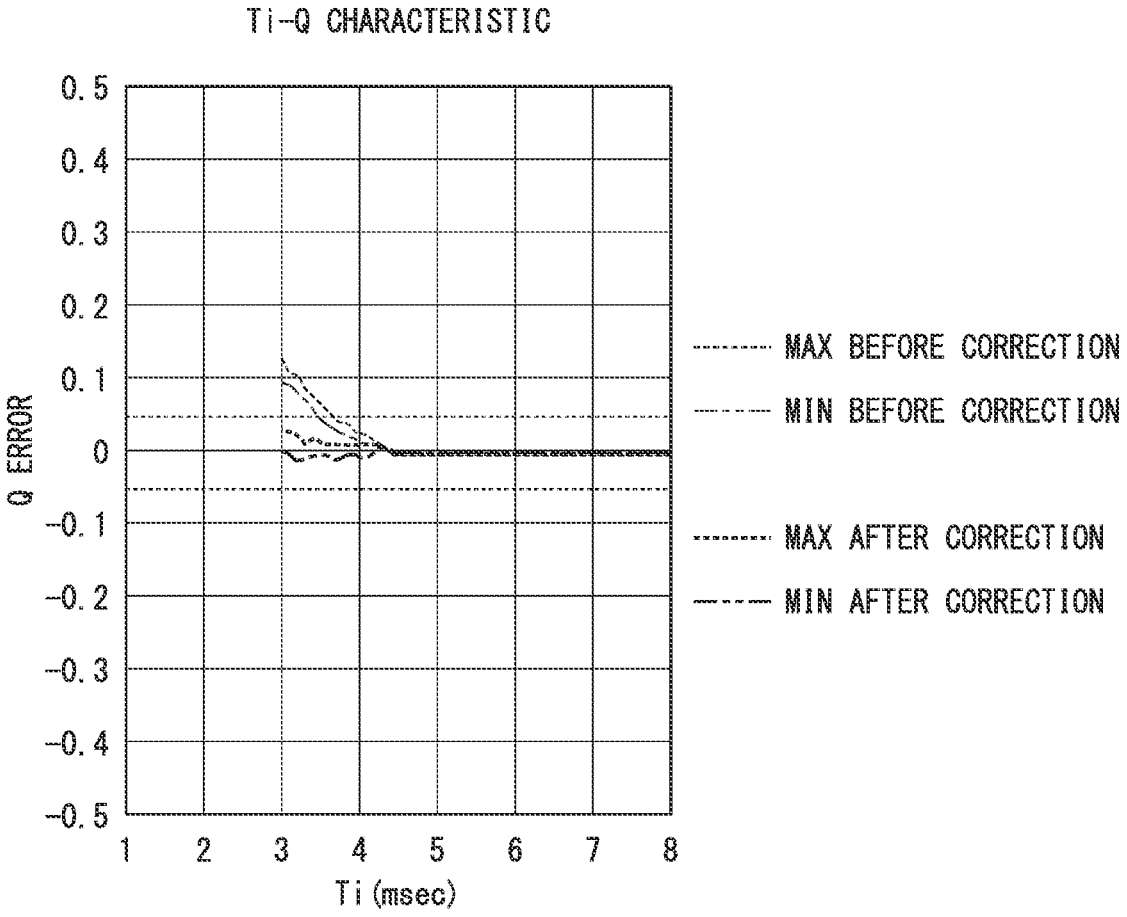
FIG. 4B is a diagram showing an example of experimental results of the fuel injection device according to this embodiment.

FIGS. 4A and 4B are diagrams showing an example of experimental results of the fuel injection device 1 according to this embodiment.

FIG. 4A shows actual measurement values indicating the relationship of an injection volume to current application time. Further, FIG. 4B shows actual measurement values indicating the relationship of an error with respect to current application time.

In the graphs of FIGS. 4A and 4B, time of the horizontal axis corresponds to time of the horizontal axis shown in the graph of FIG. 2A. That is, a range from 1 millisecond to 2.8 milliseconds in the graphs of FIGS. 4A and 4B corresponds to time t1 of FIG. 2A. A range from 2.8 milliseconds to 4.2 milliseconds in the graphs of FIGS. 4A and 4B corresponds to time t2 of FIG. 2A. A range from 4.2 milliseconds to 8 milliseconds in the graphs of FIGS. 4A and 4B corresponds to time t3 of FIG. 2A.

Regarding experimental conditions, an environmental temperature is 25 degrees and a voltage is 14.5 volts. The maximum value of the valve opening current is in a range of 4.75 amperes to 4.92 amperes and the minimum value is in a range of 4.17 amperes to 4.33 amperes. Further, the maximum value of the holding current is in a range of 2.00 amperes to 2.17 amperes and the minimum value is in a range of 1.62 amperes to 1.75 amperes.

In the experimental conditions, the injection volume of FIG. 4A greatly deviates from a linear line in the period of time t2 before correction. However, it is found that both the maximum value and the minimum value after correction become approximately the same as the linear line.

Further, also with respect to the error of FIG. 4B, similarly, before correction, a large error is found in the period of time t2. However, it is found that after correction, an error is improved.

As described above, also from the experimental results, it can be found that due to the processing of the fuel injection device 1 according to an embodiment of the present invention, even if a timing of stopping fuel supply to the internal combustion engine is a timing at which a current which is applied to the solenoid coil in order to open and close the valve changes transiently, it is possible to stabilize the amount of fuel which the fuel injection device 1 supplies to the internal combustion engine.

In addition, an embodiment of the present invention has been described. However, the fuel injection device 1 described above has an internal computer system. Further, a process of the processing described above is stored in a computer-readable recording medium in the form of a program, and a computer reads and executes the program, whereby the above processing is performed. Here, the computer-readable recording medium refers to a magnetic disk, a magneto-optical disk, a CD-ROM, a DVD-ROM, a semiconductor memory, or the like. Further, a configuration may be made such that the computer program is delivered to a computer by a communication line and the computer receiving the delivery executes the program.

Further, the above program may be a program for realizing some of the functions described above.

In addition, a so-called differential file (a differential program) which can realize the above-described functions in combination with a program already recorded in a computer system is also acceptable.

Some embodiments of the present invention have been described. However, these embodiments are those presented as an example and do not limit the scope of the invention. Further, various omissions, substitutions, or changes can be performed within a scope which does not depart from the gist of the invention.

What is claimed is:

1. A fuel injection device comprising:

a current output section configured to output current for a request time based on control by a current control section; and a fuel injection section configured to inject fuel base on the current output by the current output section, where, in a case where an end timing of the request time is in a third time domain in which the current which is applied by the current output section changes transiently, the third time domain being between a first time domain where the current output section applies a first current amount to allow the fuel injection section to inject the fuel and a second time domain where the current output section applies a second current amount to allow the fuel injection section to continue to inject the fuel, the current control section being configured to correct the end timing of the request time by a correction amount based on the first current amount, the second current amount, and a period of the third time domain.

2. The fuel injection device according to claim 1, wherein the current control section is configured to correct the end timing of the request time to become earlier at the correction amount, the correction amount being set to be linearly changed from maximum in a case where the end timing of the request time is at a start point of the third time domain, to zero in a case where the end timing of the request time is at an end point of the third time domain.

3. The fuel injection device according to claim 1, further comprising:

a time monitoring section configured to identify a current timing with a timing at which the current output section begins to apply a current as a starting point;

a current detection section configured to detect a current amount of a current which is applied by the current output section; and a current amount writing section configured to record the current timing identified by the time monitoring section and the current amount of a current, which is applied by the current output section, detected by the current detection section and corresponding to the current timing, in a storage section with the current timing and the current amount correlated with each other.

* * * * *